United States Patent [19]

Miller et al.

[11] 4,170,342

[45] Oct. 9, 1979

[54] PIVOTAL ROOF FENCE APPARATUS

[76] Inventors: Silas N. Miller, 15300 Kittridge Rd., Saratoga, Calif. 95070; Otis M. Martin, 5624 Bodie Ct., San Jose, Calif. 95123

[21] Appl. No.: 894,125

[22] Filed: Apr. 6, 1978

[51] Int. Cl.[2] ..... E04H 17/16

[52] U.S. Cl. ..... 256/26; 52/69

[58] Field of Search ..... 256/26, DIG. 2; 52/66, 52/69, 72, 196, 200, 204, 207, 311; 135/4 R, 6; 220/18; 404/25

[56] References Cited

U.S. PATENT DOCUMENTS

| | | | |
|---|---|---|---|
| 2,708,346 | 7/1955 | Smith | 61/65 |
| 2,805,884 | 9/1957 | Kinsman | 52/69 X |
| 2,930,387 | 3/1960 | Streich et al. | 135/6 X |
| 3,665,661 | 5/1972 | Beckerer | 52/204 X |
| 4,021,131 | 5/1977 | Bakken et al. | 404/25 |

FOREIGN PATENT DOCUMENTS

| | | | |
|---|---|---|---|
| 251400 | 5/1926 | United Kingdom | 52/66 |

*Primary Examiner*—Wayne L. Shedd
*Attorney, Agent, or Firm*—Schatzel & Hamrick

[57] ABSTRACT

A pivotal roof fence unit comprising elongated base members for attachment to a roof surface member extending the entire length of the unit and, at least at both ends of the unit, cross members and buttresses used to support the fence member, and pivotal connecting means for connecting the upper portion to the base members such that the upper portion may be pivoted either forward or backward relative to the long axis of the base members.

10 Claims, 4 Drawing Figures

PIVOTAL ROOF FENCE APPARATUS

BACKGROUND OF THE INVENTION

1. Field of the Invention

This invention relates generally to decorative roof fences and more specifically to a novel roof fence unit which includes features that allow it to be pivoted fore or aft to provide clearance for maintenance of the roof or equipment installed nearby.

2. Description of the Prior Art

Many large buildings, particularly business and apartment buildings, have flat roofs upon which are mounted air conditioning equipment and associated elements that due to their size would be visible from the ground. Many communities have passed ordinances requiring that such exposed equipment be enclosed from view either by extension of the walls of the buildings or by the erection of decorative roof top fences. Since the objectives of the ordinances requiring such fences or wall extensions are primarily aesthetic, permanently constructed wood slats, panels and other wood-surfaced fencing materials are the most commonly used and accepted roof top decorative materials.

A problem encountered in the use of ordinary fencing construction is that it provides a substantial obstacle to subsequent roof resurfacing operations and in many cases must be removed prior to such operations. This requires dismantling of a rather expensive structure and an even more expensive reconstruction thereof.

A further difficulty with fence constructions of the ordinary type is that they cannot be built too close to mechanical equipment located on the roof or else it becomes impossible to work effectively on the equipment. Avoiding this difficulty thus requires that the equipment be installed at least a working distance away from the fence.

SUMMARY OF THE PRESENT INVENTION

It is therefore an object of the present invention to provide a sturdy, decorative roof fence which may be pivoted in either of two directions so as to make working around it convenient.

Briefly, the present invention relates to a pivotal roof fence unit of predetermined length which includes at least a pair of base members which are intended to be secured to the roof top in parallel disposition to each other and an upper portion which includes a triangular arrangement of a fence member which is continuous over the entire length of the unit and a plurality of buttresses and cross members. The upper portion is secured to the base members by hinges which are attached so that by disconnecting the pivot pins of the hinges on one side of the unit the upper portion can be pivoted away from the bases and out of the way.

Each base member is provided with a pitch pocket or a flashing box which is typically made of aluminum or galvanized metal and fits around the respective base members so that pitch or other sealing material may be poured around the base member to provide a seal against leakage.

An advantage of the present invention is that it provides a sturdy, decorative roof fence which may be pivoted out of the way or removed completely without destruction to allow work on the roof or equipment located closed to the fence.

These and other objects and advantages of the present invention will no doubt become apparent after reading the following detailed description of the preferred embodiments which are illustrated in the several figures of the drawings.

IN THE DRAWING

DETAILED DESCRIPTION OF THE PREFERRED EMBODIMENT

Figure 1:
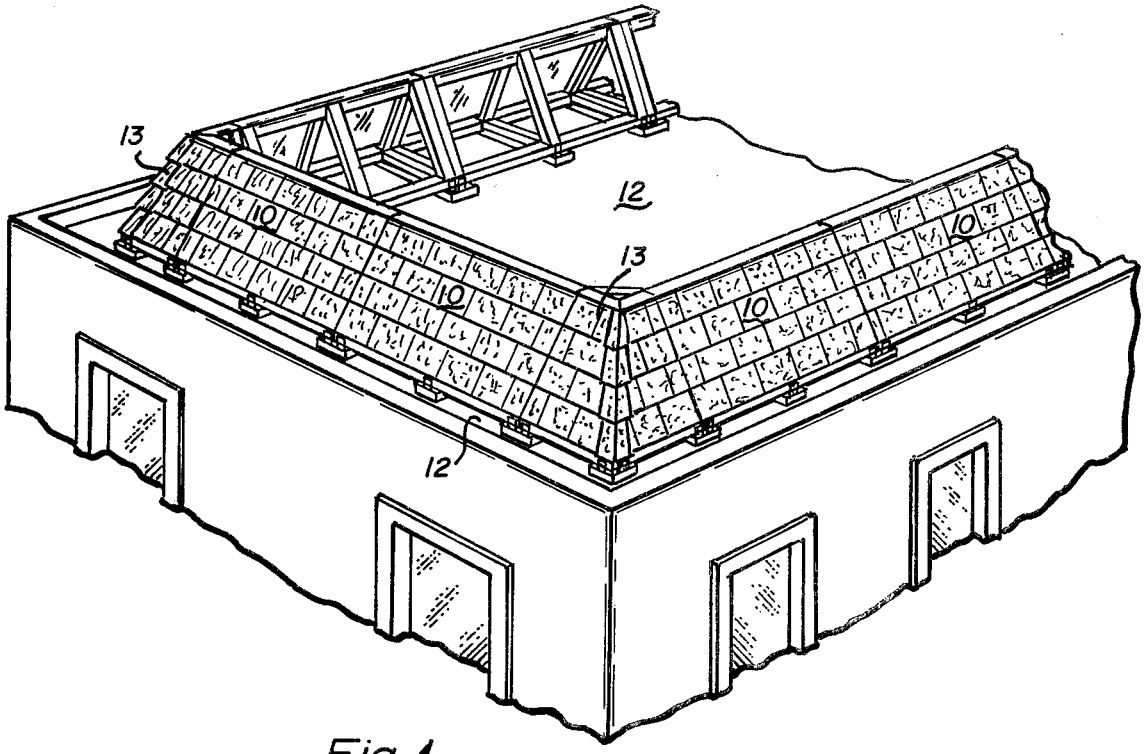
FIG. 1 is a broken perspective view showing a building roof top having a number of fence units in accordance with the present inventions installed to form a fence.

Referring now to FIG. 1 of the drawing there is shown a perspective view of a building having several roof fence units 10 in accordance with the present invention installed upon a roof 12 to create a fence. Corner fence units 13 are also shown which may be either permanently affixed to the roof or pivotally affixed thereto in a manner similar to the fence units to be described below.

Figure 2:
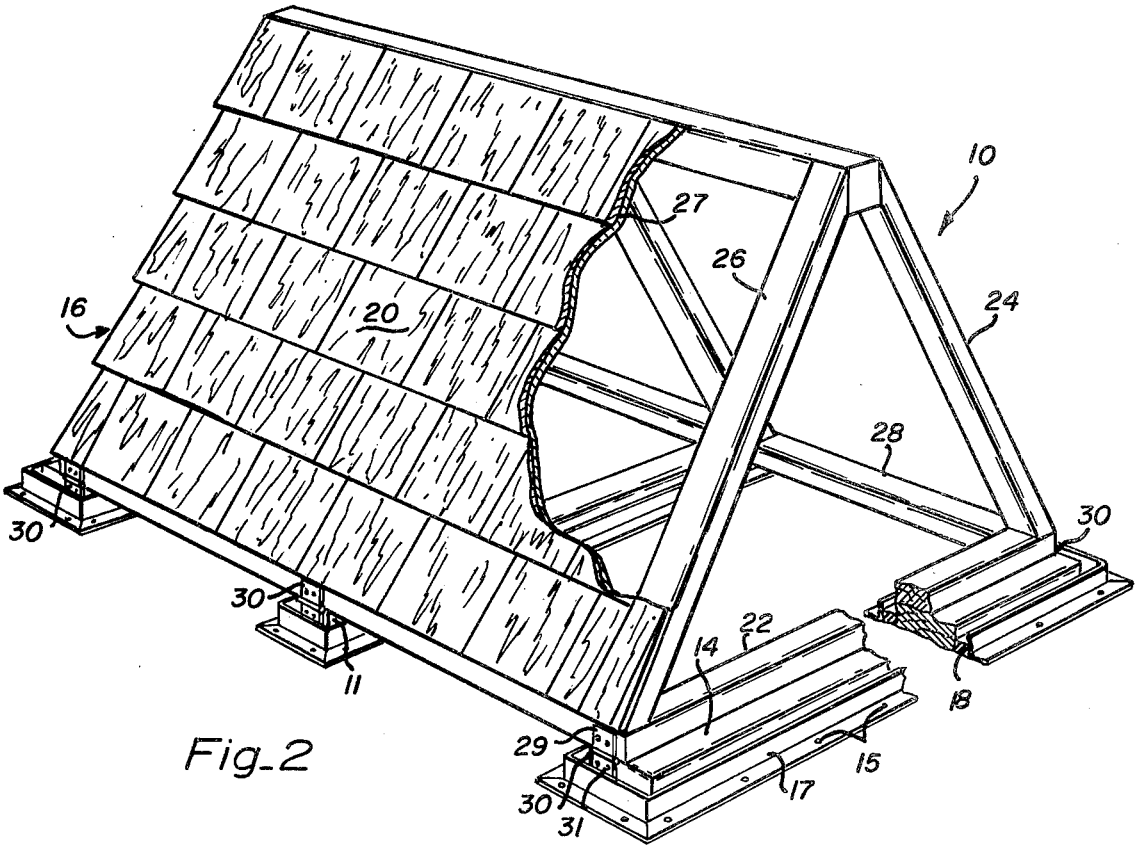
FIG. 2 is a partially broken perspective view showing a roof unit in accordance with the present invention.
Figure 3:
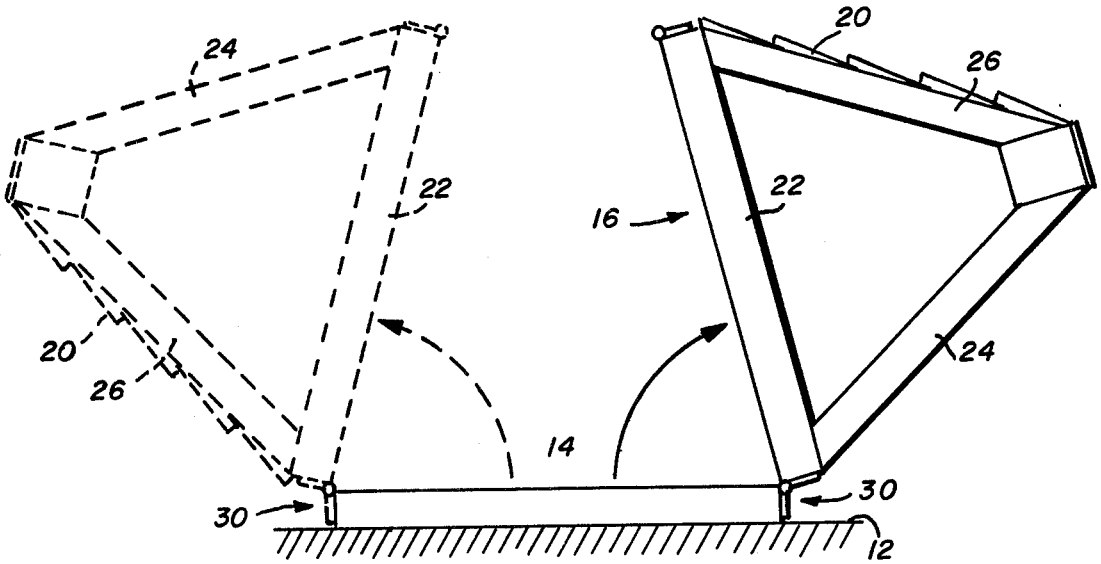
FIG. 3 is an elevational view showing an end of the unit illustrating pivoting action of the upper portion thereof.

In FIG. 2, a partially broken perspective view of a roof unit 10 is shown as installed upon a roof. As illustrated, each unit 10 includes a plurality of elongated base members 14 which are adapted to be affixed to a roof surface by lag bolts, screws or other suitable means 15, and an upper portion 16 which will be described below. In a typical case, the interior base members 11 might take the form of 4×6 inch treated wood beams, while the end base members might be constructed of 4×12 inch beams to accommodate adjacently installed upper portions. Alternatively, individual 4×6 inch end base members are separate pitch boxes could be used if the fence members 20 are extended to have an overhang at each end.

In order to waterproof the interface between base beam and roof, a pitch box or flashing box 17 may be used. In either case, pitch or other suitable sealing material 18 is deposited within the containers formed around the bases by the boxes 17 so as to insure that moisture does not collect under the beams or allow water to leak into the roof around the bolts 15.

The upper portion of the unit 10 is generally made up of three parts; a fence member 20, cross members 22, and buttress members 24. The fence member 20 typically includes a rectangular frame 26 and a plywood sheet 27 or other means for supporting cedar shakes, tiles etc., for forming a decorative front surface The fence member 20 extends continuously along the length of the unit but may have an end treatment which interlocks with an adjacent unit to provide a joint continuity.

The second component parts of the upper portion are a plurality of cross members 22 which are similar in number and length to the base members 14.

The third component parts of the upper portion are the butresses 24 which extend from the top edge of the fence member 20 to the back ends of the cross members 22 and are affixed thereto to support member 28. In the preferred embodiment, for added stability, a back member 28 is also rigidly connected between the rearmost ends of the cross members 22.

The upper portion 16 is connected to the base members 14 by hinges 30 which are attached along both the front and back sides of the unit as illustrated. The hinges 30 are of conventional construction and of the type which includes a pivot pin that may be knocked out so that the hinge plates 29 and 31 may be separated.

Referring now to FIG, 3, a right end elevation of the embodiment shown in FIG. 2 is illustrated to demonstrate how it may be pivoted either fore or aft as required to provide access to the underlying roof surface or adjacent equipment. As can be seen, base members 14, which are rigidly attached to roof surface 12, remain in a horizontal position at all times. However, when the hinges on either the front or the back side of the fence unit 16 are disconnected by removing the appropriate pivot pins, the entire upper portion may be pivoted on the hinges that remain connected and may be flipped back out of the way of anyone trying to work upon the roof or on items near to where the fence unit would normally sit when in its upright position. Illustrated is the pivoting of the upper portion over the back hinges; shown in phantom is the unit pivoting on the front hinges as well.

Figure 4:
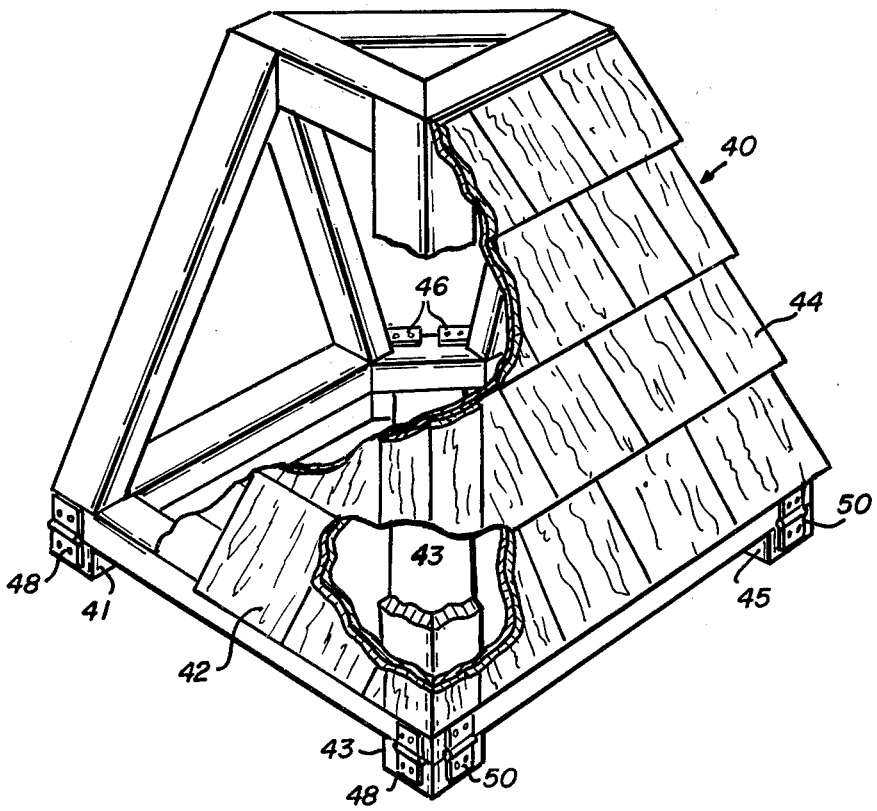
FIG. 4 is a perspective view illustrating a corner fence unit in accordance with the present invention.

In FIG. 4 a corner fence unit is shown at 40. The construction is substantially the same as that of the units described above except that it is of course adapted to accommodate intersecting fence surfaces 42 and 44, and it includes either pivoting or non-pivoting tie-down fixtures 46 at the rear. The base members 41, 43 and 45 are of course not disposed parallel to each other but are laid out as illustrated. It will also be appreciated that where hinge type fasteners are used at 46, 48 and 50 the unit will be pivotable about any of three different axes by merely removing the hinge pins from the hinges of the other two sides.

The dimensions of fence units of the type describe above may be varied to suit the needs of the user. In the preferred embodiment, the length of the unit is approximately 8 feet with one interior set of base and support frame members located at the center of the unit. The height of the triangle formed by the upper portion is approximately 4 feet.

Although the present invention has been described above in terms of the presently preferred embodiments, it is to be understood that such disclosure is by way of example only and is not intended to be considered as limiting. Accordingly, it is intended that the appended claims are to be interpreted as covering all alterations and modifications as fall within the true spirit and scope of the invention.

What is claimed is:

1. A pivotal fence unit, comprising:

base means adapted for attachment to a horizontally disposed support surface;

a fence structure disposed above said base means and including first means forming an upstanding decorative outer fence surface, buttress means affixed to an upper portion of said first means to provide lateral support therefor, and second means forming cross members rigidly securing a lower portion of said first means to a lower portion of said buttress means; and hinge means affixing a first side of said fence structure to said base means so as to permit said fence unit to be rotated about a first axis from a first position directly above said base means to a second position, and further affixing a second side of said fence structure to said base means so as to permit said hinge structure to be rotated about a second axis from said first position to a third position, said hinge means including hinge elements comprised of a first plate attached to said fence structure, a second plate attached to one of said base means, and a removable hinge pin pivotally coupling said first plate to said second plate.

2. A pivotal fence unit as recited in claim 1 wherein when viewed in a vertical cross section taken transverse to said fence structure said first means and said buttress means form the legs of a triangle the base of which is formed by said cross members.

3. A pivotal fence unit as recited in claim 1 wherein when viewed in a vertical cross section taken transverse to said fence structure said first means and said buttress means form the legs of a triangle the base of which is formed by said cross members.

4. A pivotal fence unit as recited in claim 1 wherein said first means also forms another decorative outer fence surface which intersects the first mentioned outer fence surface to form a fence corner.

5. A pivotal fence unit as recited in claim 4 wherein said hinge means also affix a second side of said fence structure to said base means so as to permit said hinge structure to be rotated about a second axis from said first position to a third position, said hinge means including hinge elements comprising of a first plate attached to said fence structure, a second plate attached to one of said base means, and a removable hinge pin pivotally coupling said first plate to said second plate.

6. A pivotal fence unit as recited in claim 5 wherein said first means also forms another decorative outer fence surface which intersects the first mentioned outer fence surface to form a fence corner.

7. A pivotal fence unit as recited in claim 6 wherein said hinge means also affix a third side of said fence structure to said base members so as to permit said fence structure to be rotated about a third axis from said first position to a fourth position.

8. A pivotal fence unit as recited in claim 1 and further comprising means forming sealing chambers upon said support surface and wherein said base means includes a plurality of elongated beams respectively disposed within said sealing chambers.

9. A pivotal fence unit as recited in claim 1 wherein said fence structure is an elongated device intended to be placed end-to-end with other similar devices to form a decorative fence on the roof of a flat topped building.

10. A pivotal fence unit, comprising:

base means adapted for attachment to a horizontally disposed support surface, including a plurality of elongated beams;

a fence structure disposed above said base means and including first means forming an upstanding decorative outer fence surface, buttress means affixed to an upper portion of said first means to provide lateral support therefor, and second means forming cross members rigidly securing a lower portion of said first means to a lower portion of said buttress means;

hinge means affixing at least one side of said fence structure to said base means so as to permit said fence unit to be rotated about a first axis from a first position directly above said base means to a second position; and means forming sealing chambers upon said support surface enclosing said elongated beams of said base.

* * * * *